United States Patent [19]

Stenzel

[11] Patent Number: 4,629,447

[45] Date of Patent: Dec. 16, 1986

[54] METHOD AND APPARATUS FOR PRODUCING LIDS FOR CONTAINERS WITH FOLDED CORNER TEAR TABS

[75] Inventor: Peter Stenzel, Herscheid, Fed. Rep. of Germany

[73] Assignee: Alcan Ohler GmbH, Plettenberg/Ohle, Fed. Rep. of Germany

[21] Appl. No.: 709,581

[22] Filed: Mar. 7, 1985

[30] Foreign Application Priority Data

Mar. 8, 1984 [DE] Fed. Rep. of Germany ..... 3408488

[51] Int. Cl.[4] ..... B31B 1/14; B31B 9/90

[52] U.S. Cl. ..... 493/356; 493/80; 493/963

[58] Field of Search ..... 493/80, 81, 86, 356, 493/357, 229, 232, 237, 79, 353, 963; 53/133

[56] References Cited

U.S. PATENT DOCUMENTS

| | | | |
|---|---|---|---|
| 768,484 | 8/1904 | Ruth | 493/356 |
| 974,704 | 11/1910 | Parrish | 493/229 |
| 1,130,590 | 3/1915 | Gage | 493/353 |
| 2,276,854 | 3/1942 | Margadant | 493/353 |
| 2,933,023 | 4/1960 | Weber | 493/232 |
| 3,054,679 | 9/1962 | Bradford | 53/133 |
| 3,183,800 | 5/1965 | Farrell et al. | 493/59 |
| 3,610,113 | 10/1971 | Schwarzkopf | 493/229 |
| 4,410,089 | 10/1983 | Bortolani | 206/633 |

FOREIGN PATENT DOCUMENTS

| | | |
|---|---|---|
| 1586221 | 5/1971 | Fed. Rep. of Germany . |
| 2018698 | 11/1971 | Fed. Rep. of Germany . |
| 3018876 | 12/1981 | Fed. Rep. of Germany . |
| 3100761 | 7/1982 | Fed. Rep. of Germany . |

*Primary Examiner*—Francis S. Husar
*Assistant Examiner*—William E. Terrell
*Attorney, Agent, or Firm*—Finnegan, Henderson, Farabow, Garrett & Dunner

[57] ABSTRACT

A method and apparatus for producing rectangular lids with a folded tear tab at each corner from a continuous web of foil using a cutting device to cut a generally perpendicular incision opposite each other in each edge of the foil web, a folding tool having two angled folding edges running toward each other in a direction toward the middle of the foil web and intersecting at a point in the cutting plane of the cutting device that folds the areas of foil on both sides of the incision back on themselves to form two tear tabs, and a cut-off device to cut the foil web into discrete lengths in continuation of the cuts in the edges of the web to form the lids.

32 Claims, 12 Drawing Figures

METHOD AND APPARATUS FOR PRODUCING LIDS FOR CONTAINERS WITH FOLDED CORNER TEAR TABS

BACKGROUND OF THE INVENTION

The invention relates to a method for manufacturing rectangular lids, with tear tabs at the ends of the lids, from a foil web in which an incision is cut through to the edge of the foil in at least one of the two long edges, then the areas of foil on both sides of the incision are folded back on themselves along fold lines to form the tear tabs and the foil web is cut-off to form the lids.

The invention also concerns a device for manufacturing square lids with tear tabs at the corners of the lids from a foil web using a frame in which the foil is held, at least one cutting device for cutting an incision through to the edge of the foil in at least one of the two longitudinal edges of the foil, as well as a folding device with a folding tool and a cut-off device for cutting the foil web into lengths to form the lids; the folding tool moves back and forth between a starting position located on one side of the foil web and an end position on the other side of the foil web, and as it moves if folds back on themselves the areas of foil on both sides of the cutting plane to form the tear tabs which are at least partially held down by the folding tool when it reaches its end position.

A procedure and device of the type mentioned at the beginning are known from German Patent DE-PS No. 15 86 221. This patent describes a machine for closing filled containers, such as TV dinner trays, with lids, which are also produced with this machine. For this purpose, a web of, for example, aluminium or plastic foil is paid out from a roll and runs stepwise through a device for manufacturing the lids. This device consists of a sequential arrangement of a cutting station, folding station, and a cut-off station for cutting off the lids. Then the lids are fed to a sealing station where the containers are sealed shut. Each container is provided with an outwards extending flange. After being placed on the container the lid is crimped down and around this flange. The dimensions of the tear tabs extending over the entire length of the narrow sides of the container are such that after the lid has been crimped on, the free end sections of the tabs are arranged on the upper side of the lid where they are thus easy to take hold of.

Each lid is folded upwards over the entire length of and parallel to one of its short sides, as formed by the longitudinal edges of the foil web, and two incisions through to the edge of the lid and arranged at a certain distance apart are cut in it. The lid thus possesses three tear tabs by means of which it can be easily and completely detached from the container in three strips extending over the total width of the short end of the container.

The incisions are cut at the cutting station during the stationary phase between two steps in the advance of the foil web by means of two cutting devices arranged at a certain spacing from each other in the form of paired knives. The amount of advance between two stationary phases corresponds to the length of the three tear strips.

On the next advance the foil web which is incised in this manner is fed to the folding station in which the areas of foil between the incisions are folded by a folding tool of appropriate length.

In the following cut-off station the sections of foil are cut-off between two incisions so that a lid is formed with two tear tabs arranged at the corners of the lid and a tear tab in the middle between them.

The production of lids according to this known procedure requires relatively complex, precisely mutually adjusted devices that take up a lot of space. Just to form the tear tabs it requires two knives spaced a certain distance apart and a separate folding station whose operating elements are exactly adjusted to the knives, as well as a cut-off station. The length of each station requires its own drive.

A further disadvantage is the fact that a relatively large number of incisions per lid has to be cut and the corresponding foil areas have to be folded. The additional consumption of foil material is also correspondingly large in comparison with the area of the lid.

The conversion of the system to lids or tear tabs of different dimensions can be carried out only in a special workshop because not only the knives in the cutting station and the folding tool in the folding station have to be readjusted to the new dimensions, but also both stations must be adjusted relative to each other and to the cut-off station to take account of the new feed rate.

It is the purpose of the invention to further develop a method and a device of the kind mentioned at the beginning in such a way that the lids can be manufactured without impairing their tear-off properties with little design-related and procedural effort.

SUMMARY OF THE INVENTION

As far as the method is concerned, this goal is achieved by cutting incisions in the foil web at one single processing station between two steps in the advance of the foil web and by folding over the areas of foil thus obtained on either side of the incisions about fold lines running obliquely from the first longitudinal edge to the incision to form the corner tear tabs and by then cutting off the foil web along and in continuation of the incision.

In this manner, two adjoining lids are each provided with angled tear tabs at adjoining corners of the lids on one side of the foil web. Only one single incision is needed to produce both tear tabs. Consequently, converting the lid to other sides can be done extremely accurately and with little expenditure of time because all that is necessary is to match the advance of the foil between stationary phases and possibly also the distance between a cutting device for making the incision and a cut-off device for cutting the foil web into lengths, to the new lid dimensions. This can be done for example by increasing the feed rate while maintaining the cycle time and shifting the cut-off device. It is not necessary to change the tools. The change in the spacing between stations when converting to new lid dimensions can be eliminated entirely if, for example, the cutting of the web into lengths is carried out in continuation of the incising operation, for example by means of the appropriately adjusted cutting system.

By forming the tear tabs at an angle at the corners of the lid it is easy to pull the lid off diagonally across the entire area of the container so that the favourable tear-off properties of the lids prepared by the known method and with the known device are at least retained. An additional advantage derives from the fact that the lid is not destroyed while being detached from the container and it can therefore be more easily handled. Also less material is used in the manufacture of the lid because its dimensions do not have to be larger than is necessary to obtain a secure closure of the container. The additional amount of foil required to produce the tear tabs according to the present state of the art is eliminated.

The areas of foil around the incision are preferentially folded to a large extent during the actual incising pass. Combining the cutting and folding procedures in this manner simplifies the sequence of operations. The precise control of the foil web which is needed in the current state of the art to guarantee exact alignment between the incisions cut at the cutting station and the folding die in the subsequent folding station is one of the factors that can be eliminated.

The coincident execution of the cutting and folding operations is preferentially achieved by holding the areas of foil to be folded on both sides of the cutting plane of a stationary cutting device in order to cut the incision and then while the incision is being made the foil is moved past the cutting device in the folding direction and further folding is carried out.

In an alternative embodiment of the invention and rather than using a stationary cutting device, it is possible to first move the cutting device against the foil web to make the incision, and then to fold over the appropriate areas of foil adjacent the incision.

In yet a further embodiment of the invention it is possible to cut incisions opposite each other on both long sides of the foil web and then to cut the foil web into discrete lengths along and in continuation of these incisions.

As far as the device is concerned, the folding toll possesses two folding edges running together at an angle in a V-shaped configuration in the direction of the middle of the foil web; the imaginary point of intersection of the folding edges lies in the cutting plane of the cutting device, and the cut-off device which cuts the foil web into lengths operates along and in continuation of the incision.

The two stations required according to the current state of the art, namely the cutting station and the folding station, are now replaced by one single station at which both the cutting of the incisions and the folding of the areas of foil around the incisions is accomplished. This thus does away with not only the costly control mechanisms required to precisely align the incisions to the folding tool, but also the space required by the system in the longitudinal direction of the foil web is decisively reduced. A further reduction in the space required is brought about by the fact that now only one single cutting device is needed instead of the two cutting devices called for in the current state of the art system. Also, the corresponding dimensions of the V-shaped folding tool are much smaller than those of the square-shaped folding tool known in the present state of the art.

The cutting system preferentially takes the form of a knife which is movable relative to the foil web with its cutting edge arranged on the opposite side of the foil web to the starting position of the folding tool.

The folding tool is advantageously designed as an essentially triangular plate in which two leading edges form the folding edges.

In accordance with the invention, the folding tool has a slit running in the plane of the knife through to at least the tip of the tool; the width of this slit being greater than the thickness at least of the cutting part of the knife blade. With this design it is possible to make the cut in the foil while the folding tool is moving from its starting position to its end position, i.e. while the folding operation is taking place.

Preferentially, a die with two die edges is arranged, at least during the folding operation, on the opposite side of the foil web from the starting position of the folding tool, and the edges of the die define the pass-through opening for the passage of the folding tool during the folding operation.

In this connection it is advantageous to arrange the folding tool in its end position above the die in its working position. The die can then preferentially be moved after the folding operation from its working position to a resting position at a distance from the end position of the folding tool.

In accordance with the invention, the folding tool is designed so as to be translationally movable back and forth between its starting position, in which the folding edges are arranged parallel to the plane of the foil web and its end position. It is advantageous here to design the folding tool to move from its starting position to its end position along a circular path intersecting the longitudinal edge of the foil web. The die can also be designed to move translationally and/or along a circular path which is preferentially arranged in the plane of the circular path of the folding tool.

The functional elements needed to move the folding tool and the die are preferentially mechanically linked with each other and constrainedly driven relative to each other.

In order to achieve a particularly compact design, it is advantageous to integrate the cut-off device into the cutting and folding system.

DESCRIPTION OF THE DRAWINGS

In the following the invention is described in detail on the basis of an example of its implementation with reference to the drawings.

The drawings show.

DETAILED DESCRIPTION

Figure 1:
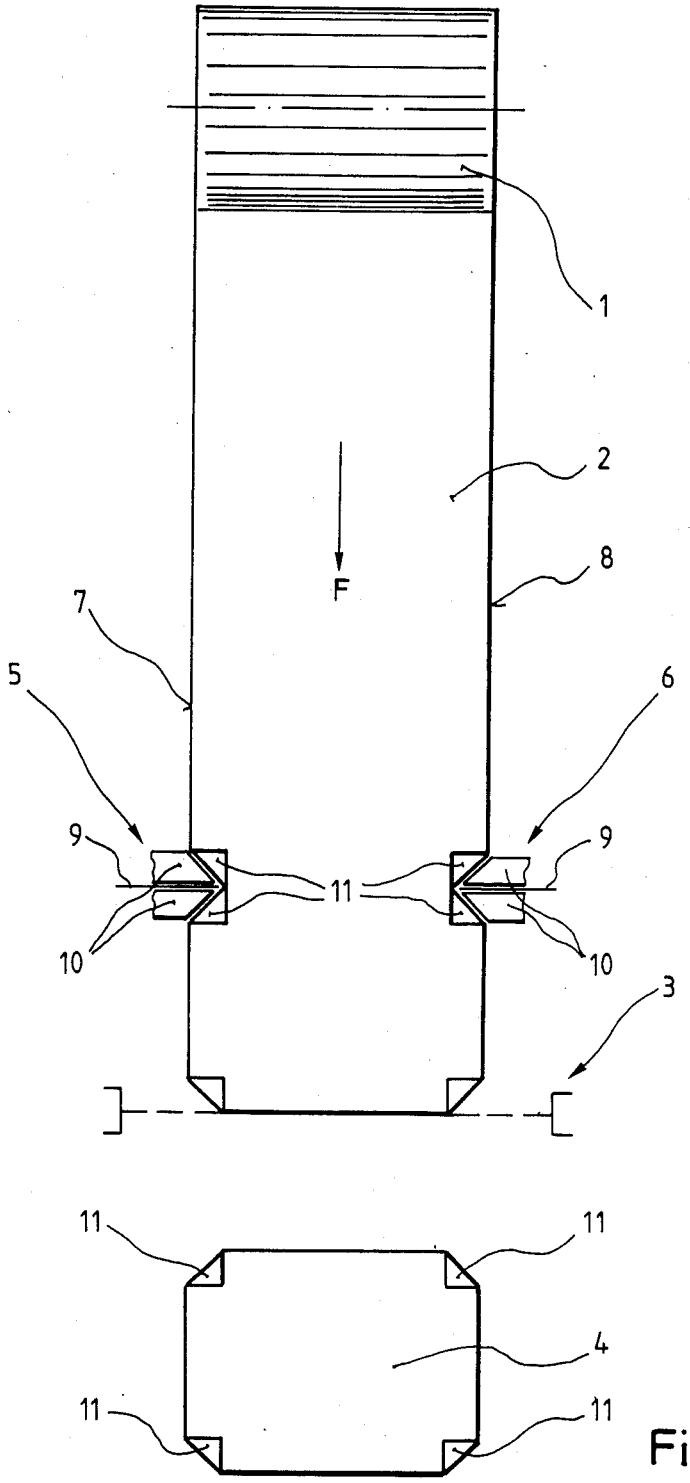
FIG. 1: A top view (diagrammatic presentation) of a device according to the invention for the manufacture of lids.

In the device which is illustrated in diagrammatic form in FIG. 1 a foil web 1 is withdrawn in steps in a horizontal plane from a storage roll 2 by means of a drive mechanism which is not illustrated. The foil web 1 passes in succession in the direction of feed F through a cutting and folding station and then a cut-off station 3 in which the foil web 1 is cut into lengths for the purpose of producing the lids 4. Next, the lids 4 can be fed to a sealing station, which is not illustrated here, for the purpose of closing filled containers.

The cutting and folding station consists of two cutting and folding devices 5, 6, one of which is assigned to longitudinal side 7 of the foil web and the other is assigned to the opposite longitudinal edge 8 of the web. Both devices 5, 6 are identical. Their corresponding structural elements are therefore identified by the same reference numbers. Each cutting and folding device 5, 6 consists of a knife arrangement 9 and a folding tool 10. Both knives 9, in a manner still to be described, cut an incision, not shown here, through to the edge of the foil, in the fold web 1. Both incisions lie along a straight line that is normal to, i.e. that perpendicularly intersects, the longitudinal edges 7,8 of the foil web. The areas of foil on either side of each incision are folded upwards and back on themselves, in a manner that is also still to be described, by means of the folding tools 10, and the fold lines run obliquely from the respective longitudinal edge 7 or 8 of the foil web to the foil-inboard end of the respective incision, as illustrated in FIG. 1. At the cut-off station 8 the foil web 1 is cut into lengths along and in continuation of the incisions, i.e. along a straight line joining them, so that each lid is provided with a triangular tear tab at each of its corners.

Figure 2:
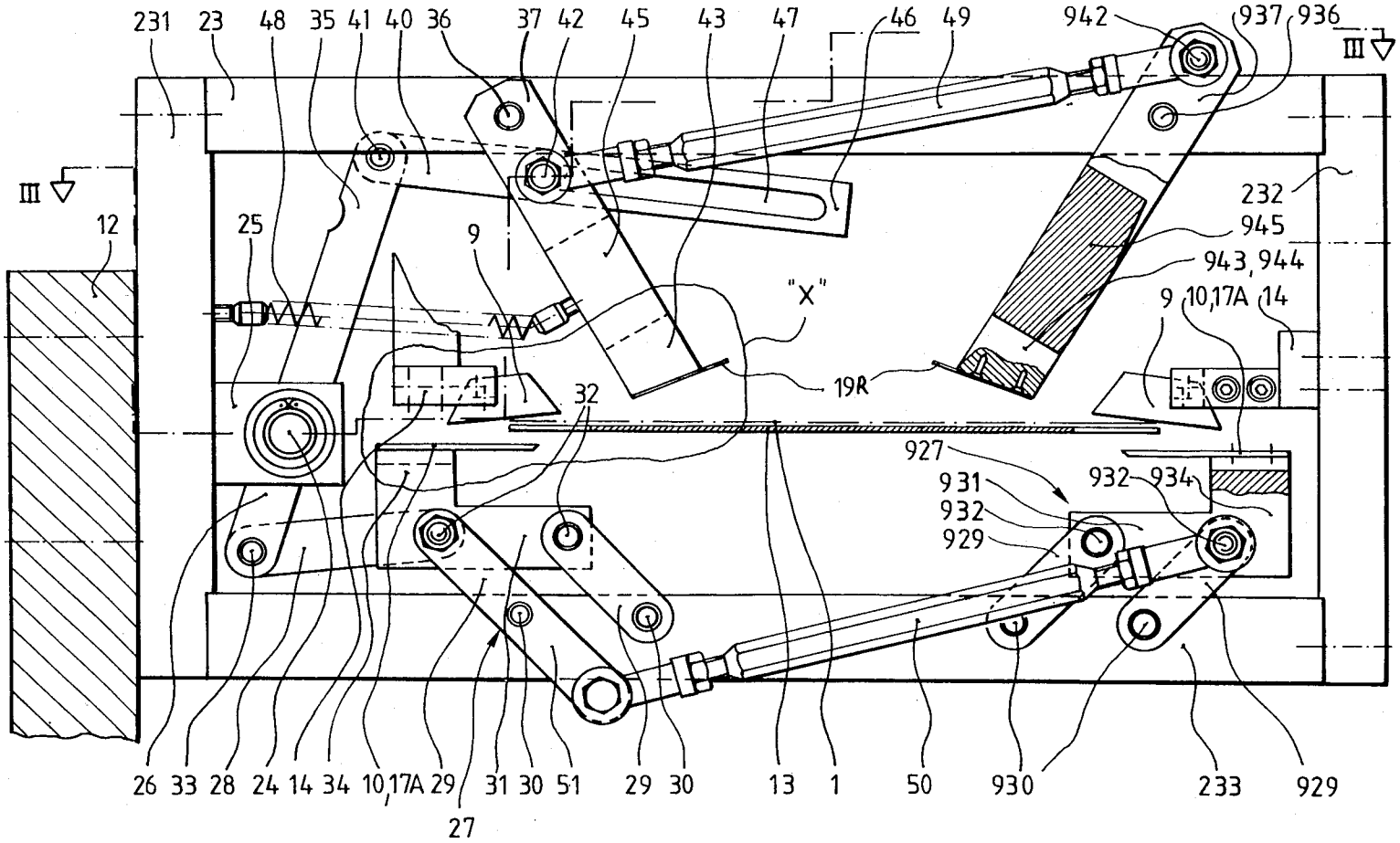
FIG. 2: A partially sectioned side view of a first design of the cutting and folding system indicated in FIG. 1, before the cutting and folding operation commences.
Figure 3:
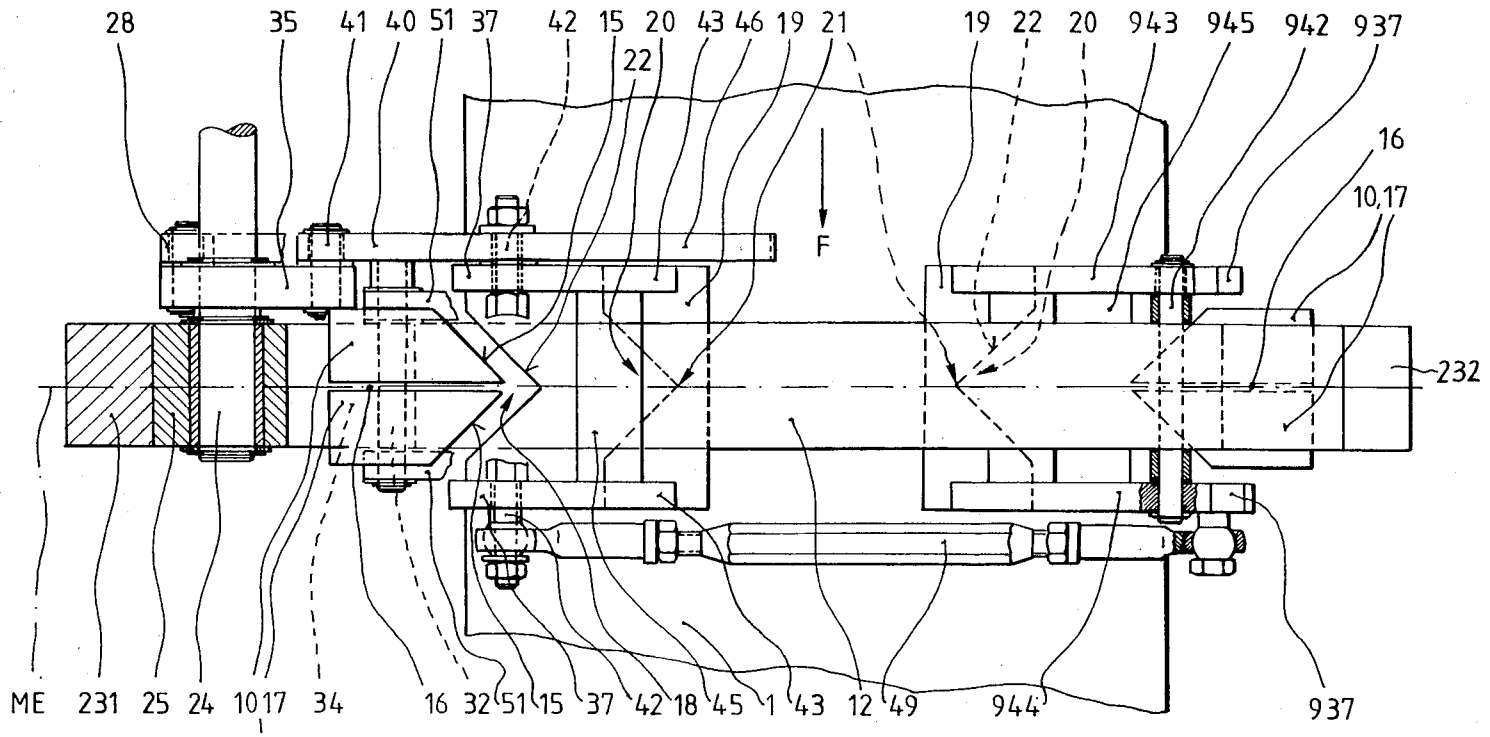
FIG. 3: A section along the line III—III in FIG. 2.

FIGS. 2 and 3 show in detail the cutting and folding systems 5, 6. Since both systems are identical, the system 5 which is assigned to the first longitudinal edge 7 of the foil web (on the left in FIGS. 2 and 3) will be described in the following. A supporting metal plate 13 for the foil web 1 is arranged beneath the web in a frame 12 which holds the entire device. In the design example shown here, the cutting device 9 takes the form of a knife, or more precisely of a knife blade, which is mounted in a fixed position in a tool holder 14 attached to frame 12. Both knives 9 are arranged in a common knife or cutting plane ME (FIG. 3) above the foil web 1 and projecting over it with about half their length. The knife plane ME runs perpendicular to the foil web 1.

The folding tool 10 is plate-shaped and at the end facing the foil web 1 it possesses an equilateral triangular projection whose apex is arranged in the knife plane ME and whose edges, which run together towards the tip to form a V, constitute the folding edges 15 of the folding tool 10. The folding tool 10 is divided into two symmetrical halves 17 by a slit 16 running the entire length of the tool. The width of the slit 16 is somewhat larger than the thickness of the knife blade 9.

Figure 4:
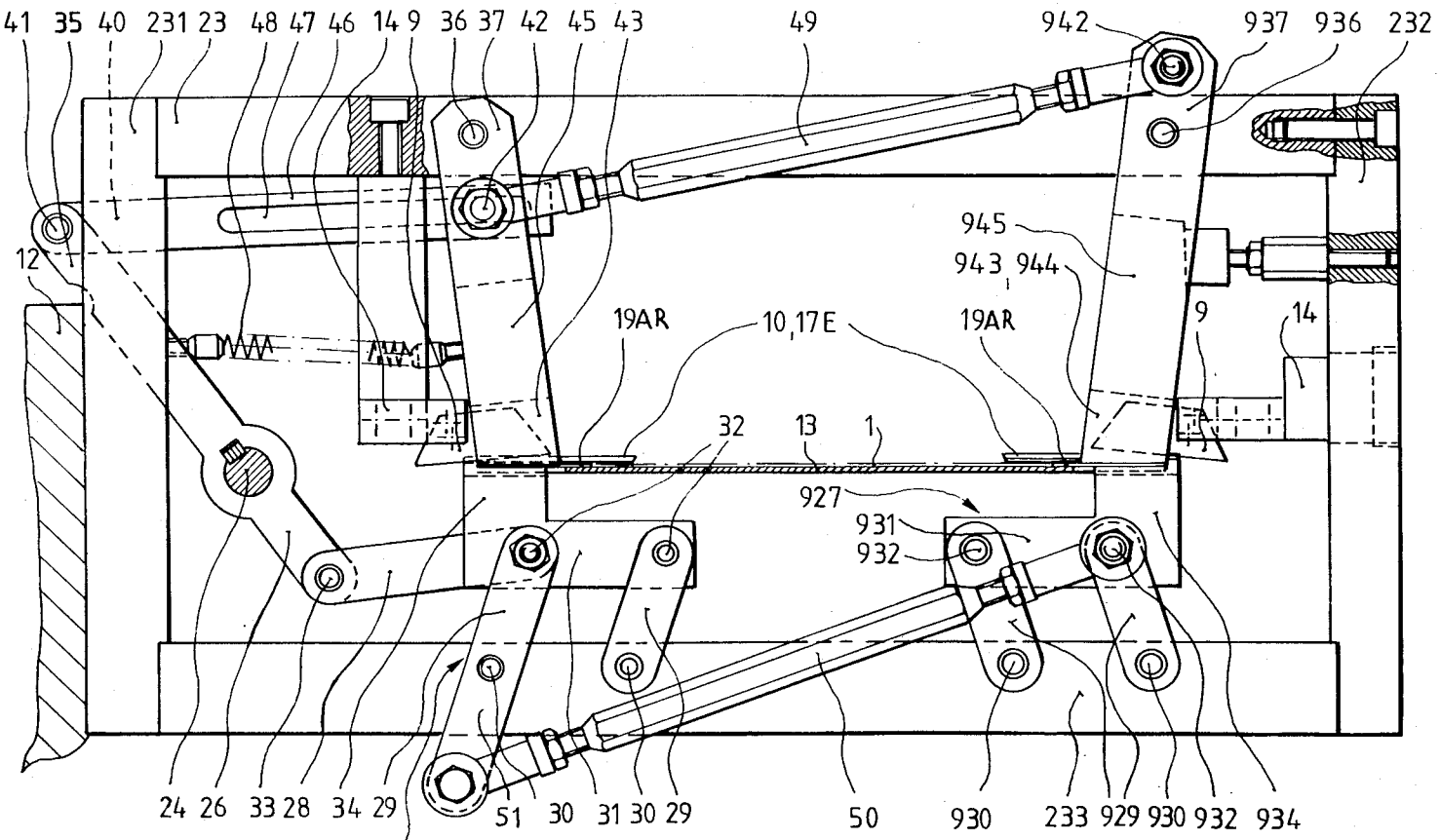
FIG. 4: A partially sectioned side view of the cutting and folding system illustrated in FIG. 2, after the cutting and folding operation has been completed.
Figure 5:
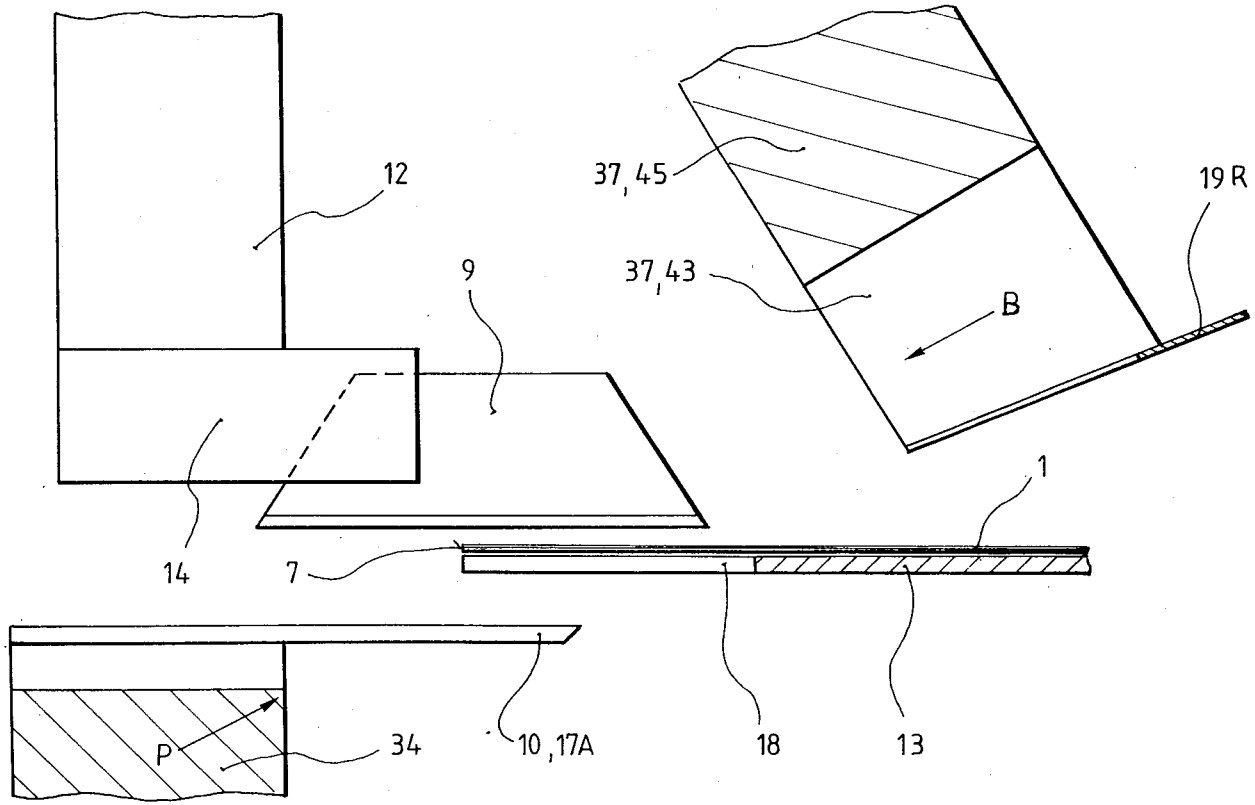
FIG. 5: An enlarged view of the section designated by an "X" in FIG. 2.
Figure 9:
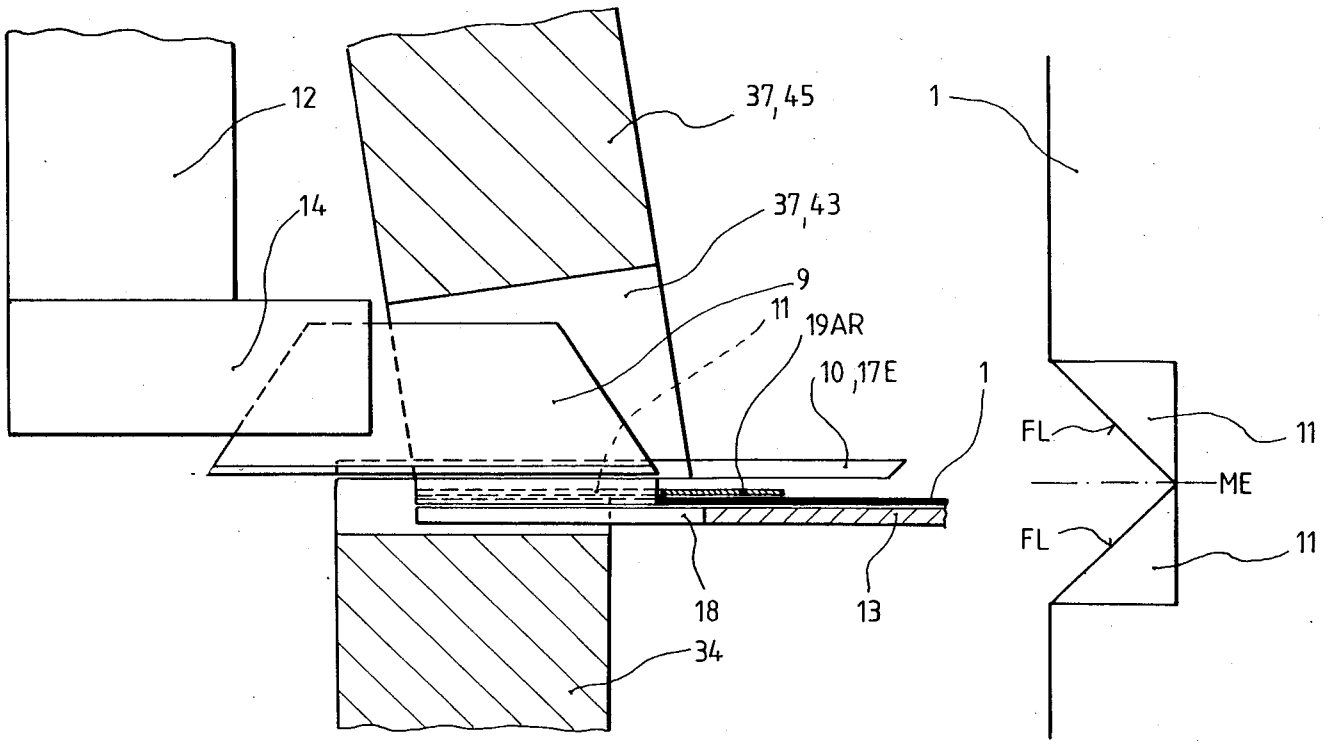

The folding tool 10 is movable from a starting position A, shown in FIGS. 2 and 5, to an end position E, shown in FIGS. 4 and 9. In the starting position A the folding tool 10 is arranged approximately parallel to and below the foil web 1. When travelling from the starting position A to the end position E the folding tool 10 moves obliquely upwards in the direction of the middle of the web. As the tool moves, its two halves 17 engage beneath the areas of foil 11 and press it on either side of the knife from its edge toward its center against the underside of the stationary knife 9 thereby making a cut in the edge of the foil. As the tool 10 continues to move upward, the knife 9, which fits into slot 16 in tool 10, continues to cut the web as the folding operation proceeds. To be precise, the cutting operation is always executed slightly ahead of the folding operation, otherwise the foil web 1 would not be cut but torn. In its end position E, the folding tool is closer to the centre of the foil web and approximately parallel to and above the web, and in this position it holds down the folded foil areas 11. The sheet metal support 13 has a triangular recess 18 cut in it which is matched to the shape of the folding tool 10 and which permits the through-pass of the folding tool during the folding operation.

In order to back up the folding operation, a plate-shaped die 19 is assigned to each cutting and folding system 5, 6. During the folding operation this die is located in its working position AR (FIGS. 4 and 6) parallel to and above foil web 1 but below the knife 9. On the side facing away from the centre of the foil web the die is triangularly notched to form through through-pass opening 20, and the tip or apex 21 of the notch lies in the plane ME of the knife. The edges of the die 19, which converge at the apex 21 and define the through-pass opening 20, are the working edges 22 of the die which, in conjunction with the folding tool 10, define the fold lines of the tear tabs 11. In other words, the folding tool 10 folds the areas of foil 11 around the edges 22 of the die. For this purpose, in the working position the apex 21 of the die 19 is arranged below the foil-inboard end of the knife 9 and the die edges 22 run at the same angle as the folding edges 15 of the folding tool 10, at least up to the respective longitudinal edge 7 or 8 of the foil web. The folding tool 10 passes with clearance through the through-pass opening 20 during the folding operation. The circular path described by the folding tool 10—and in particular by its edges 15—around the bearings 30 or 93 passes through a peak position and during the subsequent descent presses the folded areas of foil against the die 19. At the end of the folding operation the folding tool is located above the die 19 (FIG. 9). Following the folding, the die 19 is moved from its working position AR (see FIGS. 4 and 9) to a resting position R (see FIGS. 2 and 5) in order to permit the stepwise advance of the foil web 1 in the direction of feed F.

The frame 12 comprises a vertical frame section 231, 232 on either side of the foil web 1; these vertical sections are joined at their upper ends by a horizontal bridge section 23 spanning the foil web and at their lower ends by a frame member 233. The midlines of the bridge section 23 and of the frame member 233 lie along the knife plane ME and these two frame sections are approximately as wide as the folding tool 10. Their purpose is to serve as a mount for the devices that move the folding tool 10 and the die 9 from the starting position A or the resting position R to the end position E or the working position AR. These movements follow circular pathways in a constrained manner. The folding tool 10 is translationally moved.

The mechanism driving the folding tool 10 and the die 19 of the cutting and folding system 5 assigned to the first longitudinal edge 7 of the foil web (left in FIGS. 2 to 4) is described in the following paragraphs.

The folding tool 10 is driven by an oscillatingly driven drive shaft 24 running in the longitudinal direction of the foil web; this shaft is carried by a bearing bracket 25 which is attached to vertical frame section 231 approximately in the plane of the foil web 1. The oscillating movement of this drive shaft 24 is transmitted to the folding tool 10 by means of an opposite-acting double rocker mechanism. This consists of a driving rocker 26 attached to the drive shaft 24, a parallel crank mechanism 27, as well as a coupling arm 28 that joins them both. The parallel crank mechanism 27 comprises four cranks 29. One pair of these cranks 29 is mounted on each long side of the frame section 233 in the area below the longitudinal edge 7 of the foil web by means of bearings 30 attached to frame member 233. The bearings 30 of the foil-inboard and foil-outboard cranks 29 located opposite each other on the longitudinal sides of frame member 233 are in alignment with each other.

In each case one coupling link 31 in the folding mechanism joins the free upper ends of cranks 29 in each pair of cranks by means of joints 32. The joints 32 of the opposing cranks 29 are designed as shafts joining these cranks. The two coupling links 31 are joined in the area of the foil-outboard cranks 29 by a block-like member 34. The folding tool 10 is attached to the upper surface of this block-like member in such a manner that its triangular section 34 bearing the folding edges 15 projects sufficiently far beyond the member 34 in the direction of the middle of the foil in order to be able to fully fold foil sections 11. One end of the coupling arm 28 acts via a joint 33 on the driving rocker 26 and the other end acts on the joint shaft 32 of the foil-outboard cranks 29.

The die 19 is also driven by drive shaft 24. The oscillating motion of this shaft 24 is transmitted to die 19 by means of an opposite-acting double rocker mechanism. This latter consists of a driving rocker 35 attached to the drive shaft 24, an arrangement of two rockers 37 mounted on both longitudinal sides of the horizontal bridge section 23 of the frame by means of aligned bearings 36, as well as of a coupling arm 40 joining the drive rocker 35 and the rockers 37. This arm is connected to the die-driving rocker 35 by means of a joint 41 and it is connected to the rockers 37 by means of a joint 37 in the form of a shaft joining both rockers 37. Both rockers 37 possess an extension member 43 projecting beyond the joint 42 in the direction of the foil web 1. The die 19 is attached to and joins the free ends of these extension members. The mid-sections of the two extension pieces 43 are joined by a tie-bar 45.

The connecting rod 40 has an extension piece 45 projecting beyond joint 42 with a slot 47. Joint 42, which is arranged at the outer end of the slot away from the middle of the foil web when the die 19 is in its resting position R, is slidingly located in this slot. The extension pieces 43 are pretensioned towards the working positions AR of the die 19 by a tension spring attached to the vertical frame member 231 and to the tie-bar 45.

A rocker arm assembly and a parallel crank drive mechanism are provided to drive the folding tool 10 and the die 19 belonging to the cutting and folding system 6 on the second longitudinal side 8 of the foil web. These components, including all their bearings, joints, shafts, extension pieces, tie-bar and coupling elements are complementary elements to their counterparts in the cutting and folding system 5. For this reason they are identified by the same numbers which are prefixed, however, by a 9.

A connecting rod 49 is provided to transmit the movement of the die rocker arms 37 of the cutting and folding system 5 to the complementary die rocker arms 937 of the cutting and folding system 6; one end of this connecting rod 49 acts on joint 42 of the rocker arms 37 and its other end acts on the complementary joint 942 of the complementary rocker arms 937 to form a complementary opposite-acting double rocker arm mechanism driving the die.

The movement of the parallel crank drive 27 and thus of the folding tool 10 of the cutting and folding system 5 is transmitted to the complementary parallel link drive 927 of the cutting and folding system 6 by means of a connecting rod 50; and end of this connecting rod 50 acts on an extension 51 of one of the foil-outboard cranks 29 of the parallel crank mechanism 27 and its other end acts on the joint 932 of the foil-outboard cranks 929 of the complementary parallel crank drive 927.

The coupling element 50 and the connecting rod 47 are arranged on the leading longitudinal side of frame member 233, which faces in the direction of feed F, or on the leading longitudinal side of the horizontal bridge section 23. The driving rocker 26 for the folding tool, the coupling arm 28, the driving rocker arm 35 for the die, the coupling arm 40 of the die system and the extension 46 of the coupling arm are arranged on the opposite, trailing longitudinal sides of the said frame members.

The mid-points of the parallel crank drives 27 and 927 are arranged approximately vertically below the foil-inboard end of the respective knife 9.

FIGS. 5 to 10 show the folding tool 10 and the die 19 of the cutting and folding system 5 belonging to the first longitudinal edge 7 of the foil web in various phases of the folding operation. The elements 10 and 19, which are not illustrated here, of the cutting and folding system 6 belonging to the second longitudinal edge 8 of the foil web are in the corresponding identical positions because of the constrained drive system already described above.

FIG. 5 shows the folding tool 10 and the die 19 in their starting A and resting R positions respectively, as already illustrated in FIG. 2. Starting from these positions, both elements 10, 19 move in the direction of the arrows P and B.

Figure 6:
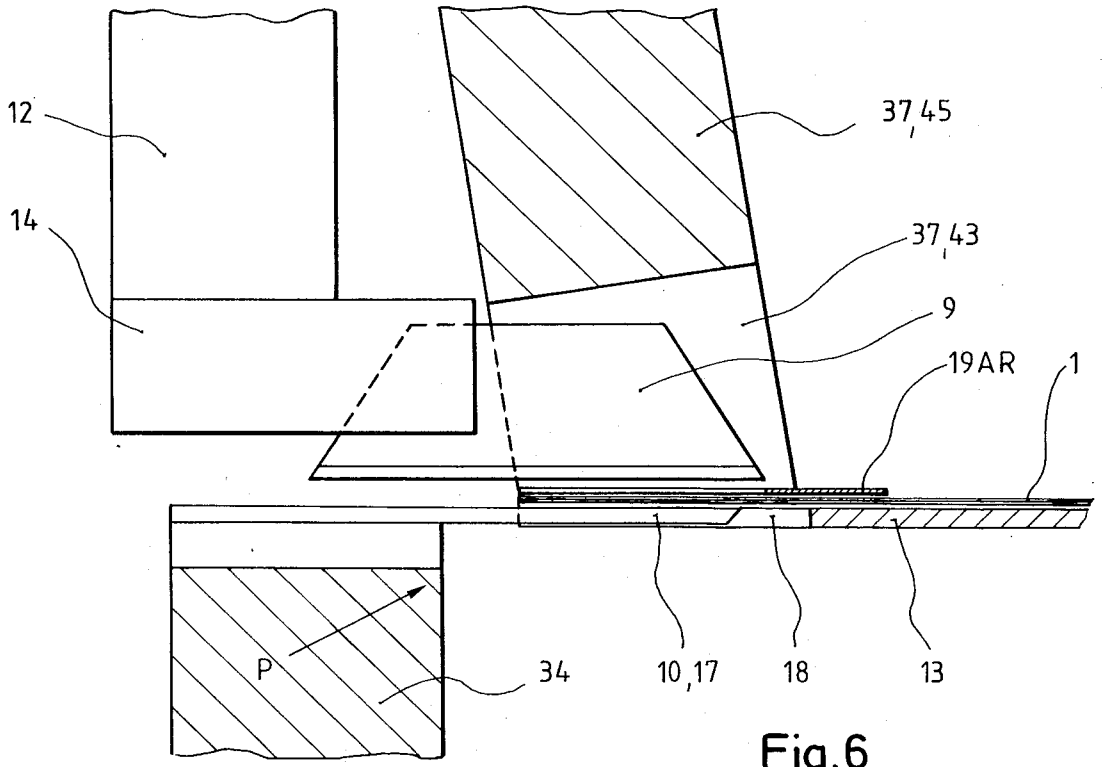
FIGS. 6 to 10: Each show a view of the cutting and folding system corresponding to FIG. 5 in successive phases of the cutting and folding operation.

FIG. 6 shows the folding tool 10 in the same plane as the support plate 13 and within the recess 18 in this plate, where it is just engaging beneath the areas of foil 11 which are to be folded. The die 19 is located in its working position AR parallel to and above the foil web 1.

Figure 7:
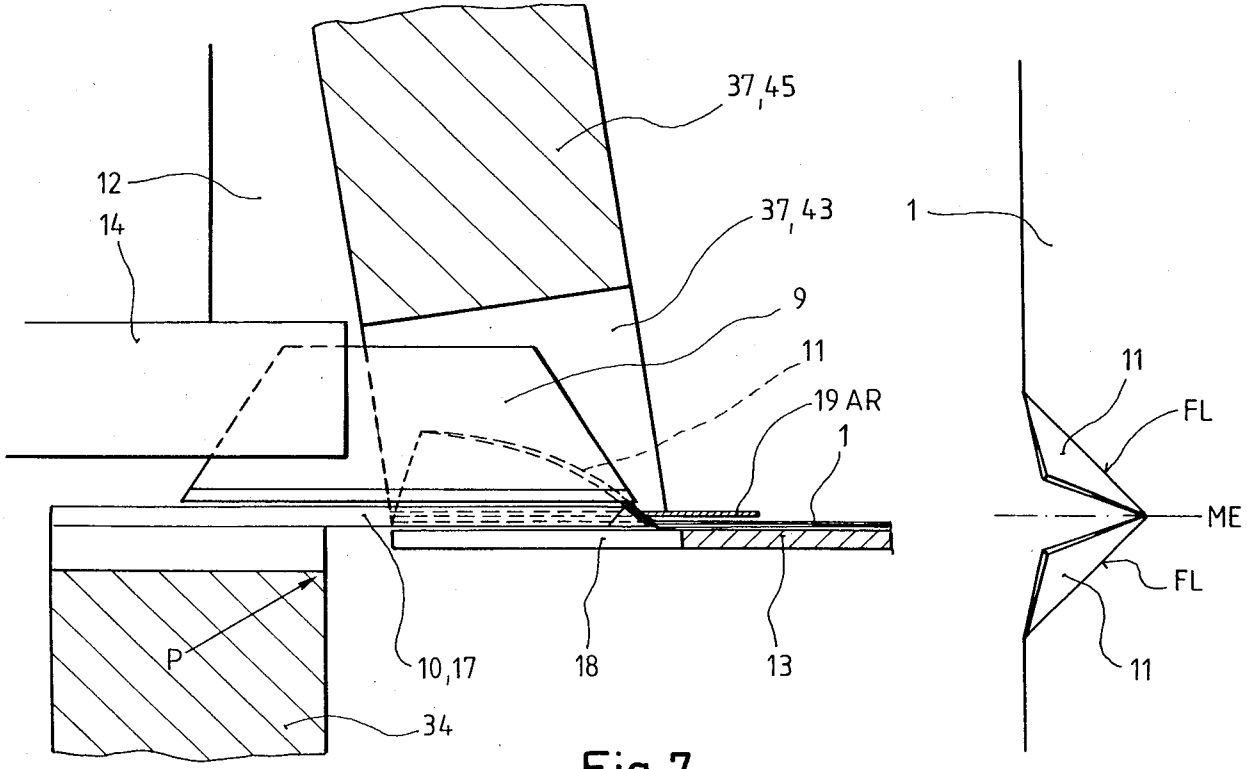

In FIG. 7 the areas of foil to be folded by the folding tool 10 have already been engaged and bent obliquely upwards past stationary knife 9. During this operation the knife 9 fits into the slit 16 in the folding tool 10 making, as the tool moves upward and forces the foil against it, an incision in and through the edge of foil web 1. The exact sequence of the cutting and folding operation has already been described further above. To the right in FIG. 7 is shown a top view of the position of the areas of foil 11 to be folded relative to the foil web 1. In this view the fold lines are indicated by the letters FL.

Figure 8:
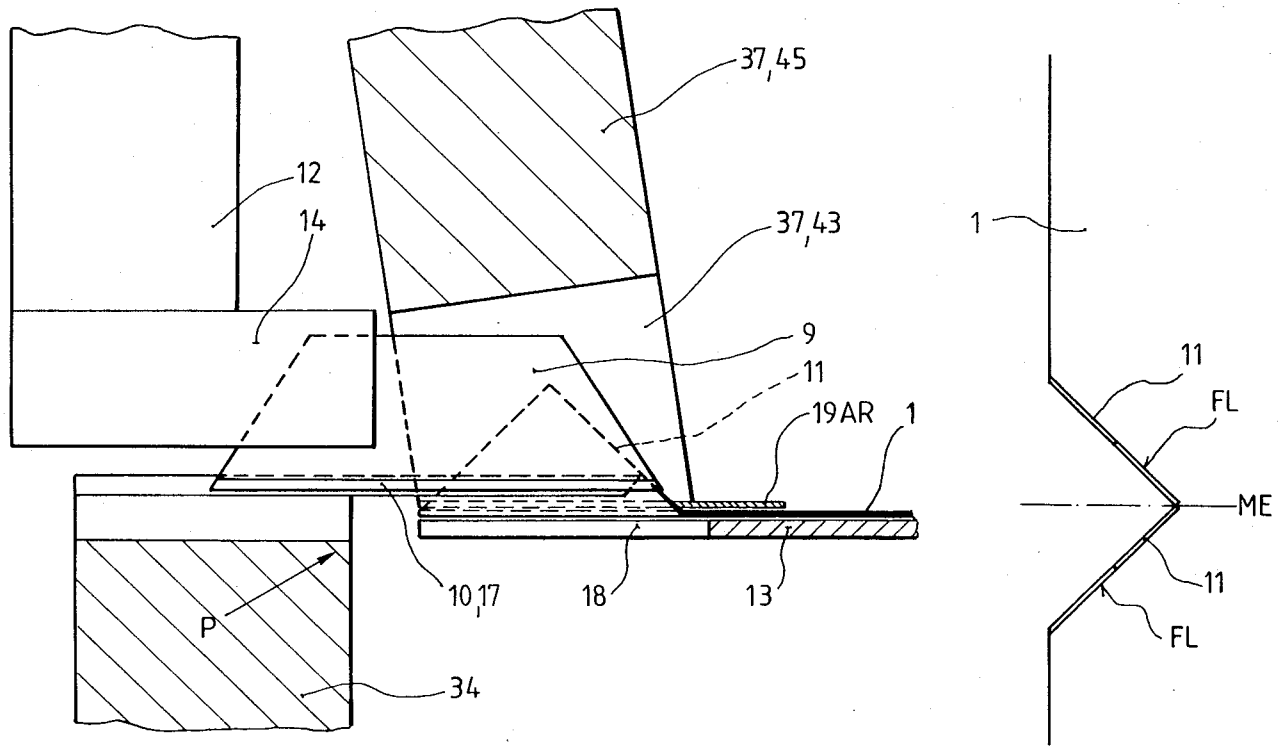

FIG. 8 shows a phase subsequent to that depicted in FIG. 7; here the upwards folded areas of foil 11 stand perpendicular to the foil web 1.

In FIG. 9 the folding operation is already completed. The areas of foil 11 to be folded have been folded fully back on themselves and are held down against the die 19 by the folding tool 10 which is now in its end position (see also FIG. 4) after it has travelled along its circular path and descended into its end position.

Figure 10:
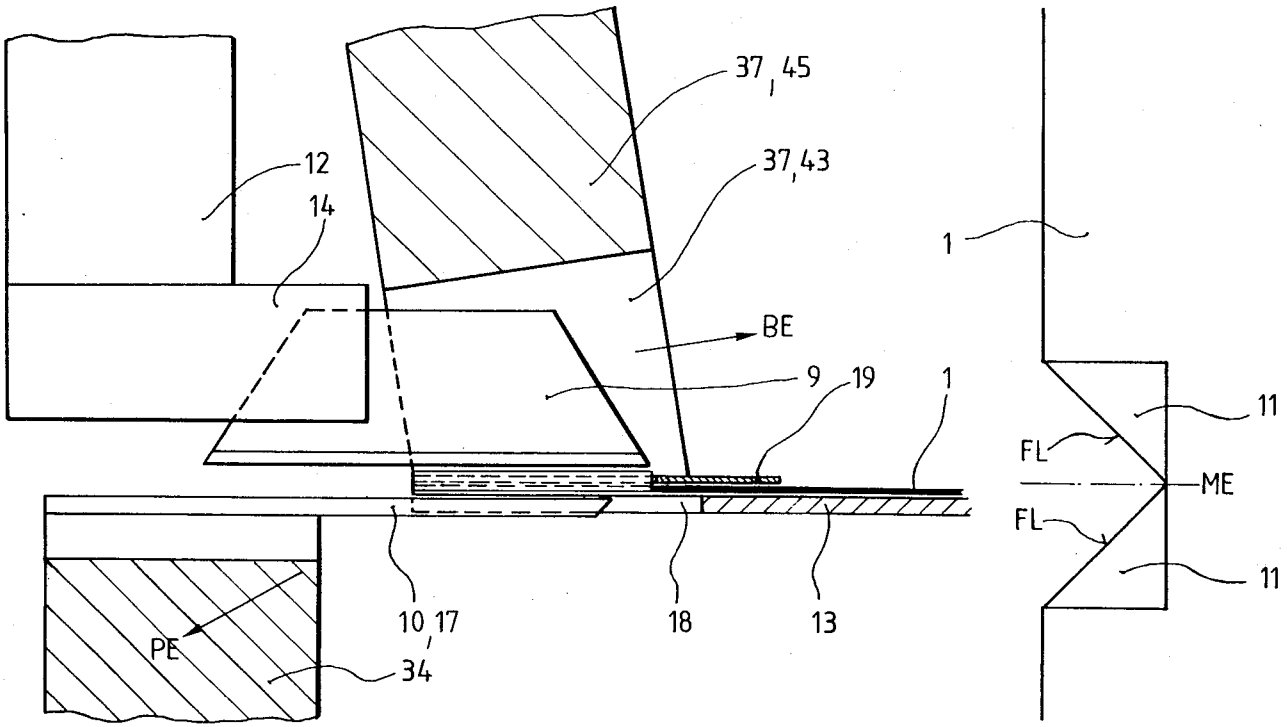

In FIG. 10 the folding tool 10 has already started to move ajain in the direction PE to its starting position A. The die 19 is located just at the beginning of of its return motion in direction BE to its resting position R. The delayed initiation of the return travel of the die 19 relative to the motion of the folding tool 10 is caused by the guidance of the joint 42 in the slot 47 of coupler extension piece 46. The return travel of the die 19 against the retaining force of spring 48 does not commence until the foil-outboard end of the slot 47 comes into contact with the joint 42.

Figure 11:
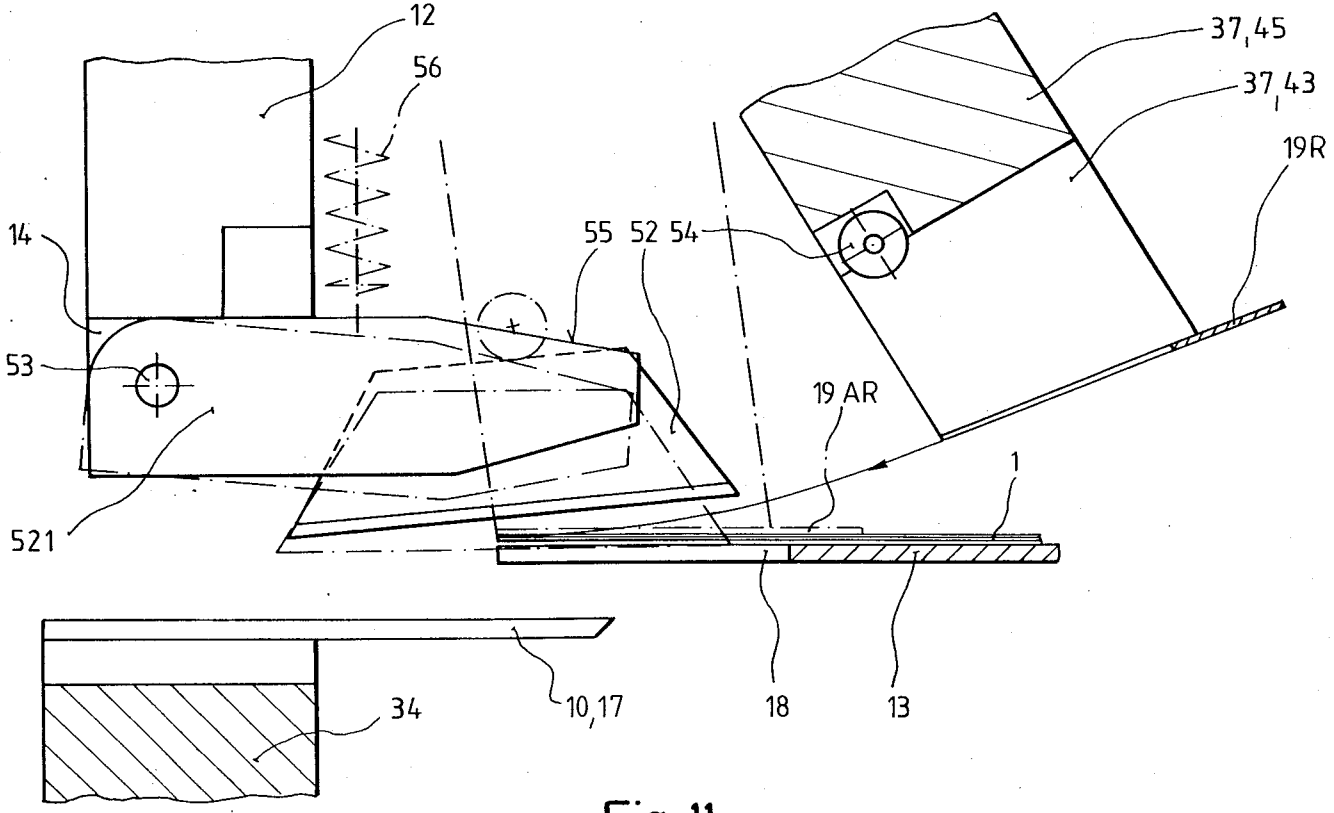
FIG. 11: A diagram corresponding to FIG. 5 and showing an alternative embodiment of the cutting and folding system.

FIG. 11 shows an alternative for the cutting device which consists here of a knife 52 which is fixed in a holder 521. The holder 521 itself is movable around a pivot 53 attached to the frame 12. The tie-bar 45 of the die rocker arm 37 is fitted at its lower end with a roller 54 which, as the die 19 travels to its working position AR, slides along an inclined surface 55 on the knife holder 521 and forces this downwards against the counteracting force of a spring 56. In the process, the knife 52 cuts an incision, open to the edge of the foil, before the folding operation commences (see broken lines).

Figure 12:
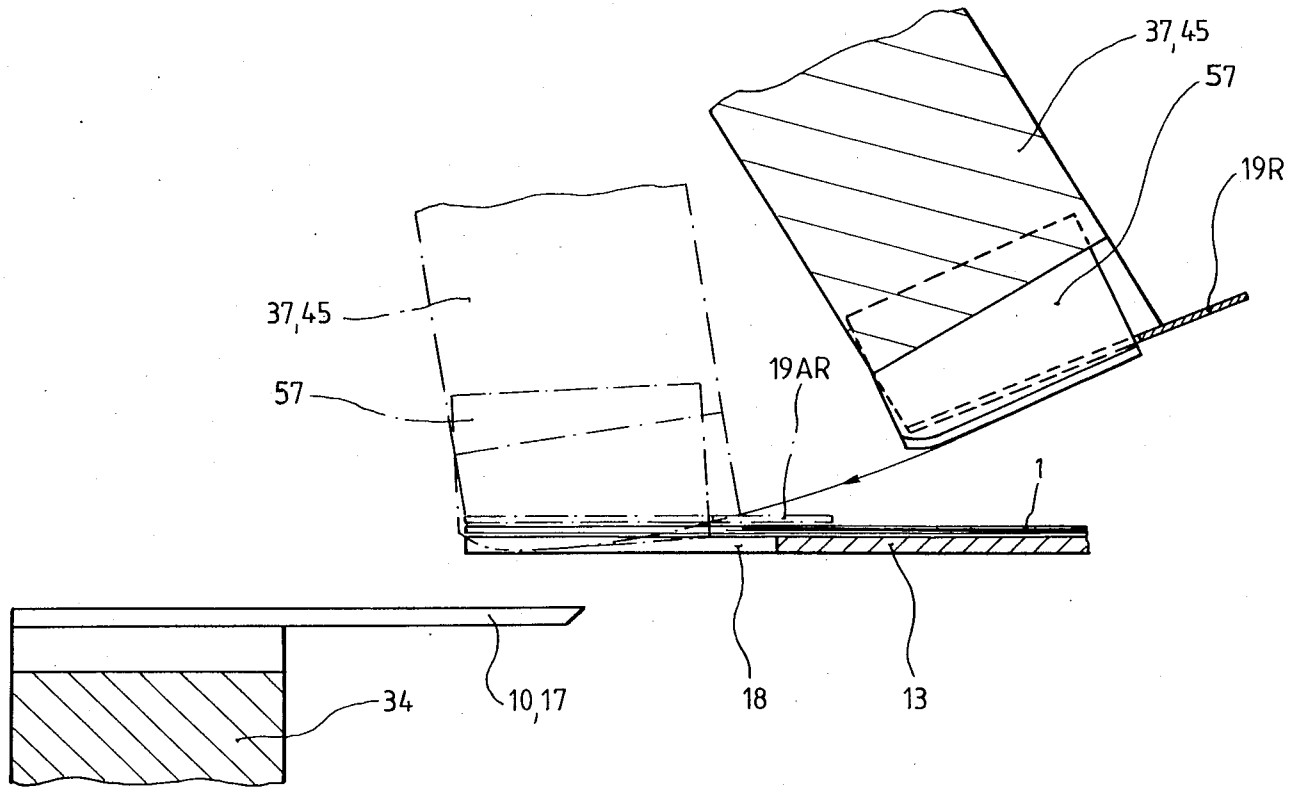
FIG. 12: A diagram corresponding to FIG. 11, and showing yet a further embodiment of the cutting and folding system.

FIG. 12 illustrates yet a further embodiment of the cutting device. Here a knife 57 is arranged in such a way on the tie-bar 45 of the die rocker arms 37 that its blade projects beyond the die 19 in the direction of the foil web 1. As a result, as the die 19 travels from its resting position R to its working position AR (see broken lines), the knife 57 cuts the incision through to the edge of the foil web 1 before the folding operation commences.

Naturally, it is also possible instead of a knife to use shown other cutting device, e.g. a fine wire or evena laser beam, to cut the incision.

I claim:

1. A method for producing rectangular foil lids for containers from an elongated foil web having tear tabs at the corners of the lid for removing the lid from the container comprising making a transverse cut in at least one of the two longitudinal edges of the web at a work station, folding the areas of foil lying on either side of the cut back on themselves along fold lines running obliquely from the edge of the web to the inner end of the cut at the same work station and thereby forming corner tabs, and thereafter cutting the foil web into discrete rectangular pieces along and in continuation of the cut in the edge of the web at a subsequent work station and thereby forming rectangular foil lids.

2. The method of claim 1, wherein the cut is made from the edge toward the center of the web and the folding step begins immediately after the edge is initially cut so that the cutting and folding occurs sequentially but nearly simultaneously at said work station.

3. The method of claim 2, wherein the cut in the edge of the web is made by pressing the foil web from the edge toward the center against and past a stationary cutting device and then folding back on themselves those areas on either side of the cut in one continuous motion.

4. The method of claim 1, wherein the cut is made by moving a cutting device through the edge of the foil and thereafter folding those areas on either side of the cut back on themselves.

5. The method as in one of claims 1–4, wherein the cut is normal to the longitudinal edge of the foil.

6. The method of claim 5, wherein a cut is made opposite each other in both longitudinal edges of the foil web and the foil web is then cut into rectangular pieces along and in continuation of the cuts.

7. A device for producing rectangular foil lids for containers from an elongated foil web having tear tabs at the corners of the lids for removing the lids from the containers comprising a frame, at least one cutting device located at a first work station on the frame for making a traverse cut in at least one of the two longitudinal edges of web, at least one folding tool also located at the same edge and at the same longitudinal location as the cutting device as the first work station and movable back and forth in a plane substantially perpendicular to the longitudinal edges of the web between a starting position located to one side of the plane of the web and an end position located on the other side of the web, said folding tool having two angled folding edges coming together to form a V-shape oriented toward the web, said edges intersecting at an imaginary point in the plane of the cut made by the cutting device, whereby movement of the tool from its starting position toward its end position folds the areas of the foil lying on either side of the cut back on themselves to form the tabs, and a cut-off device located at a second work station for cutting the foil web with folded tabs along and in continuation of the cut into discrete lengths.

8. The device of claim 7, wherein the cutting device is located on one side of the plane of the foil web and the folding tool in its starting position is located on the other side of the foil web.

9. The device of claim 8, wherein the folding tool is a triangular plate whose two leading edges act as the folding edges.

10. The device of claim 9, wherein the folding tool has a slit running at least to the tip of the tool, and oriented in the plane of the cut; the width of the slit being greater than the thickness of the knife so that the knife can pass through the slit as the folding tool moves between its positions.

11. The device of claim 7, including a die having two edges that cooperate with the edges of the folding tool, said die being located at the first work station and moveable between a working position close to the edge of the foil web on the side of the web opposite the starting position of the folding tool and a resting position away from the edge on the same side of the web, said die edges defining a pass-through opening in the die's working position for the passage of the folding tool and over which the areas of the foil web adjacent the cut are folded.

12. The device of claim 11, wherein the edges of the die while in the working position run at an angle starting from the longitudinal edge of the foil web through to the plane of the cut and intersecting at said plane.

13. The device of claim 12, wherein the apex of the edges of the die in its working postion is located at the inner end of the cut made by the cutting device.

14. The device of claim 13, wherein the folding edges of the folding tool and the edges of the die run obliquely at the same angle in relation to each other.

15. The device of claim 11, wherein the end position of the folding tool is above the die in its working position.

16. The device of claim 11, wherein the die is a flat plate and the edges of the die in the working position run essentially parallel to the plane of the foil web.

17. The device of claim 11, wherein the resting position of the die is located at a distance from the end position of the folding tool.

18. The device of claim 7, including a second cutting device and a second folding tool located at said first work station on the opposite side of the foil web for making a second cut in the other longitudinal edge of the web opposite said first cut and for folding back the areas of the foil lying on either side of the second cut.

19. The device of claim 7, including a stationary support plate on the frame beneath the foil web for supporting the web at the first work station and having a recess matched to the outer dimensions of the folding tool to permit the latter to pass through it.

20. The device of claim 7 in which the folding tool translates back and forth between its starting position and its end position in a straight line with its folding edges parallel to the plane of the foil web.

21. The device of claim 7, in which the folding tool moves from its starting position to its end position along a circular path intersecting the longitudinal edge of the foil web, with the midpoint of the circular path being approximately vertically below the inner end of the cut made by the cutting device.

22. The device of claim 11, in which the die moves back and forth between its resting position and its working position in a straight line.

23. The device of claim 11, in which the die moves along a circular path whose midpoint is located approximately vertically above the inner end of the cut made by the cutting device, and this circular path is in the same plane as the circular path followed by the folding tool.

24. The device of claim 22 or 23, in which the die is driven by an opposite-acting twin rocker arm mechansim consisting of a driven rocker arm, a first rocker arm pivotally mounted at one end on the frame and a coupling link joining the two of them, the die being mounted at the opposite end of the pivotally mounted rocker arm beyond the joint between said arm and the coupling link.

25. The device of claim 24, in which the folding tool is driven by an opposite-acting double rocker mechanism consisting of a driven rocker, a parallel crank mechanism consisting of two cranks pivotally mounted on the frame and joined by a coupling link, a coupling arm pivotally connecting one of the cranks of the parallel crank mechanism and the drive rocker, the folding tool being mounted to the coupling link of the parallel crank mechanism.

26. The device of claim 25, in which the driven rocker of the die and the driven rocker of the folding tool are the arms of a single lever which is oscillatingly driven around a pivot intermediate its ends.

27. The device of claim 26 including a second cutting device, a second folding tool and a second die located at said first work station on the opposite side of the foil web for making a second cut in the other longitudinal edge of the web directly opposite said first cut and for folding back the areas of the foil on either side of the second cut over said second die, the second die being mounted at the free end of a second rocker arm pivotally mounted to the frame and a coupling rod pivotally connected between said first and second rocker arm to form a complementary opposite-acting die.

28. The device of claim 27, including a complementary parallel crank mechanism for the second folding tool and a transmission link connecting the parallel crank mechanism to provide a complementary opposite acting folding tool.

29. The device of claim 28, in which the coupling rod between the two rocker arms is pivotally connected to the first arm coaxially with the connection between the first arm and the coupling link, said coupling link having a slot in which the connection is slidingly located, and said dies being biased in the direction of their working position.

30. The device of claim 8, in which the knife is stationary.

31. The device of claim 8, in which the knife is pivotally attached to the frame and is movable towards the foil web to make the cut.

32. The device of claim 11, in which the knife is mounted on the die and projects beyond the underside of the die in the direction of the foil web to make the cut in the foil as the die moves into its working position.

* * * * *